United States Patent [19]

Mensa et al.

[11] Patent Number: 4,531,128

[45] Date of Patent: Jul. 23, 1985

[54] BUOYANT RADAR REFLECTOR

[75] Inventors: Dean L. Mensa, Ventura; Dale C. Moss, Vandenberg, both of Calif.

[73] Assignee: The United States of America as represented by the Secretary of the Navy, Washington, D.C.

[21] Appl. No.: 401,764

[22] Filed: Jul. 26, 1982

[51] Int. Cl.[3] ..... H01Q 15/18

[52] U.S. Cl. ..... 343/18 C

[58] Field of Search ..... 343/18 C, 18 B, 18 R

[56] References Cited

U.S. PATENT DOCUMENTS

| | | | |
|---|---|---|---|
| 2,452,822 | 11/1948 | Wolf | 343/18 C |
| 2,793,362 | 5/1957 | Oberg | 343/18 C |
| 3,103,662 | 9/1963 | Gray et al. | 343/18 C |
| 3,217,325 | 11/1965 | Mullin | 343/18 C |
| 3,276,017 | 9/1966 | Mullin | 343/18 C |
| 3,277,479 | 10/1966 | Struble, Jr. | 343/18 C |
| 4,096,479 | 6/1978 | Van Buskirk | 343/18 C |
| 4,272,768 | 6/1981 | Rookard, Jr. | 343/18 C |

*Primary Examiner*—T. H. Tubbesing
*Assistant Examiner*—John B. Sotomayor
*Attorney, Agent, or Firm*—Robert F. Beers; Joseph M. St.Amand

[57] ABSTRACT

A radar reflective target consisting of a cluster of square corner reflectors configured in a cubical shape. The reflector is comprised of eight smaller blocks of light-weight radar-transparent material, such as plastic foam, with planar reflective surfaces, such as metal foil embedded between the interior faces of the individual blocks. A radar-transparent waterproof covering can be provided to protect the assembled unit.

14 Claims, 9 Drawing Figures

TRIANGULAR CORNER REFLECTOR $$RCS = \frac{4}{3}\frac{\pi a^4}{\lambda^2}$$

CIRCULAR CORNER REFLECTOR $$RCS = \frac{16}{3}\frac{\pi a^4}{\lambda^2}$$

SQUARE CORNER REFLECTOR $$RCS = 12\frac{\pi a^4}{\lambda^2}$$

BUOYANT RADAR REFLECTOR

BACKGROUND OF THE INVENTION

The present invention relates to radar targets and more particularly to lightweight, buoyant, inexpensive, easily manufactured, and highly radar reflective targets, with virtually no degradation of cross section caused by lack of flatness and orthogonality of the reflecting surfaces; and, to an efficient radar augmentation device.

Corner reflectors have long been established as effective radar targets for navigation and calibration because they can provide strong radar echoes over large angles. Their inherent simplicity of design makes them uniquely attractive for deployment in unattended and inclement environments. FIGS. 1*a*, 1*b* and 1*c* show geometric configurations of some commonly used reflectors. With a triangular corner reflector as in FIG. 1*a*, the radar cross section or strength of the radar return (RCS) is expressed as $$RCS = \frac{4}{3}\ \frac{\pi a^4}{\lambda^2},$$

where a=the length of the corner, and $\lambda$=radar wavelength. In the circular corner reflector of FIG. 1*b*, $$RCS = \frac{16}{3}\ \frac{\pi a^4}{\lambda^2},$$

and with the square corner reflector of FIG. 1*c*, $$RCS = 12\,\frac{\pi a^4}{\lambda^2}$$

The corner reflector derives its large radar reflectivity from the fact that every ray of energy incident on it is subjected to one or more reflections and is thus redirected to the source as shown in FIG. 2. Viewing FIG. 2: from optics, the angle of incidence=the angle of reflection, i.e., $\phi_i=\phi_r$; from geometry, a line crossing two parallel lines form equal angles, i.e., $\phi_r=\phi_i$, and from optics, $\phi_i=\phi_r$; so $\phi_i\phi_r=\phi_i=\phi_r$, or $\phi_i=\phi_r$, and the incident and reflective radar waves are parallel.

The critical factor in the fabrication of high quality reflectors is the requirement that the reflector surfaces be precisely flat and orthogonal. The general rule to be followed is that compliance to flatness and orthogonality should be less than one quarter of the radar wavelength. For typical radars, this is on the order of $\frac{1}{4}$ inch. Departure from these specifications causes drastic degradations in the reflected signal strength and uniformity of angular response.

The problems of fabricating efficient reflectors become particularly acute for sizes in excess of two feet at the short wavelengths of modern radars. Experience has shown that the inherent warp of rolled metal stock used for fabrication and the distortions induced in the welding process cause significant degradation. Solutions to these problems require the use of metals that have been machined flat or necessitate costly fastening processes that allow alignment of the component plates. The cost of a triangular reflector four feet along the corner, for example, typically ranges between $500 and $750.

SUMMARY OF THE INVENTION

The primary object of the present invention is to provide a lightweight, buoyant, inexpensive, easily manufactured, omni-directional, highly radar reflective target with little or no degradation of cross section caused by lack of flatness and orthogonality of the reflecting surfaces.

The radar reflective target is made from a cube of low density, low dielectric, foamed plastic or other lightweight, radar-transparent material which is cut three times, for example, to form eight smaller cubes. The interior faces of each of the eight cubes are covered with a radar reflective material such as metallic foil and rejoined in the form of the original cube thus forming eight corner reflectors. If desired, the reformed cube can then be covered with a waterproof material to prevent possible corrosion of the reflective surfaces.

These and other objects and advantages of the invention will become apparent to those skilled in the art from the following detailed description of the preferred embodiments thereof, with reference to the accompanying drawings.

DESCRIPTION OF THE PREFERRED EMBODIMENT

Figure 3A:
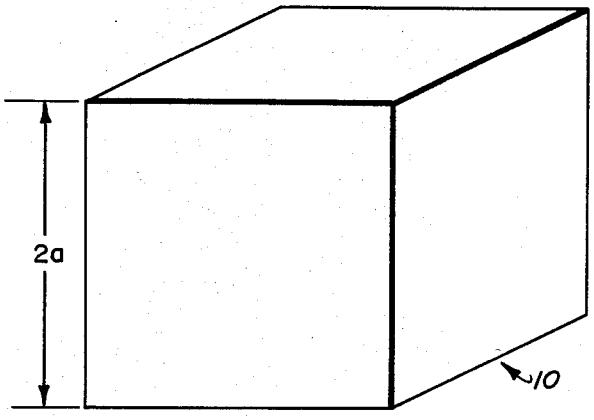
FIGS. 3*a*, 3*b*, 3*c* and 3*d* show the construction of a lightweight buoyant radar reflector of the present invention.
Figure 3B:
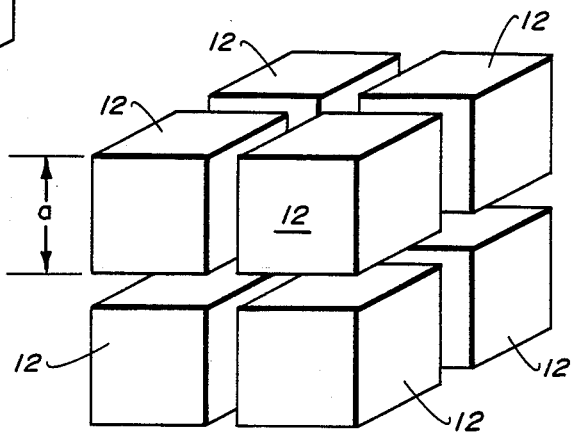
Figure 3C:
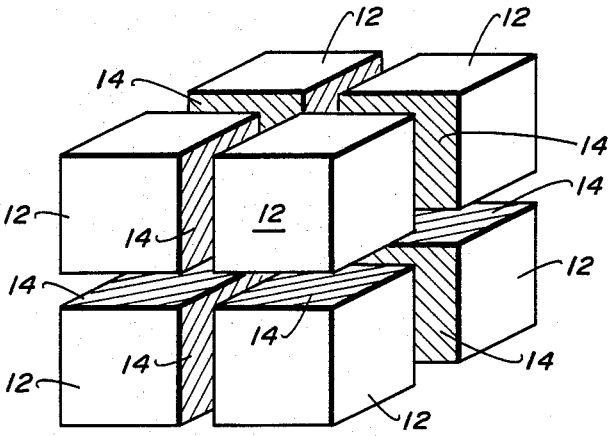

The radar reflective target can be made from a cube 10, as shown in FIG. 3*a* of low density, low dielectric foamed plastic, such as Styrofoam, or other lightweight, radar-transparent material. This cube is cut three times to form eight smaller cubes 12, as shown in FIG. 3*b*. The interior faces of each of the eight cubes 12 are covered with a radar reflective material 14 such as aluminum or other metallic foil, for example, as shown in FIG. 3*c*, and rejoined in the form of the original cube using any suitable radar transparent cement thus forming a cube as in FIG. 3*d* comprising eight corner reflectors. The reformed cube can then be covered with a radar-transparent waterproof material to prevent possible corrosion of the reflective surfaces, if desired; however, this is not necessary in most instances as the foamed plastic is highly waterproof.

Figure 1A:
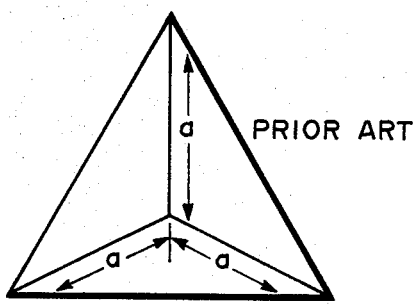
FIGS. 1*a*, 1*b*, and 1*c* show typical triangular, circular and square corner reflectors, respectively.
Figure 1B:
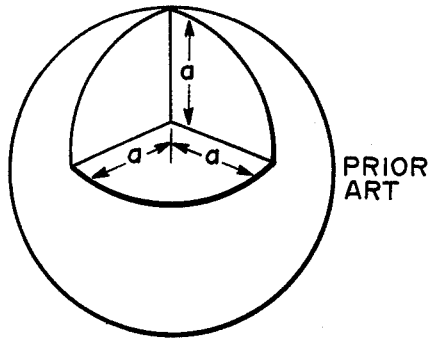
Figure 1C:
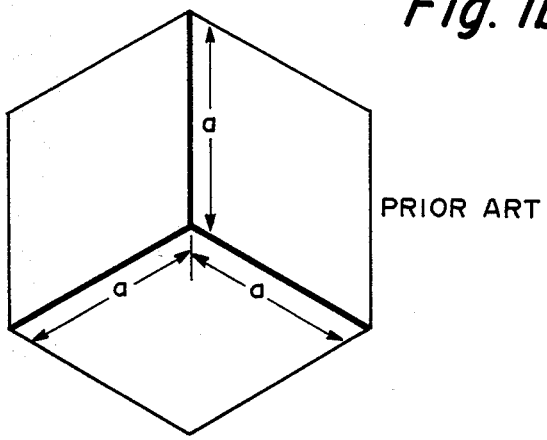
Figure 2:
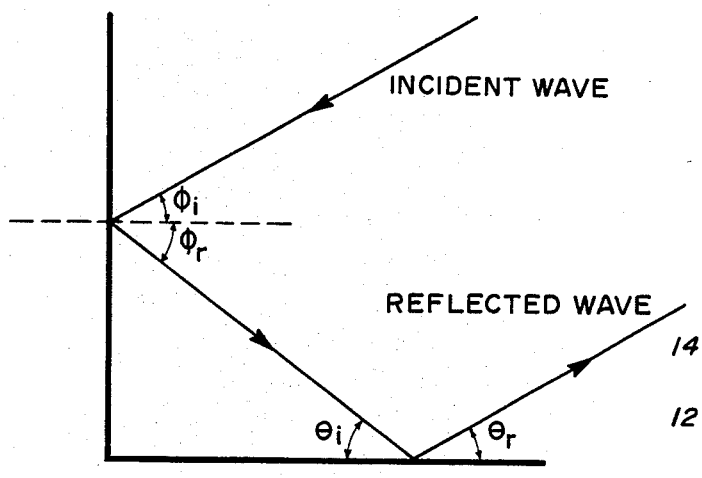
FIG. 2 is a diagram illustrating reflectivity of a corner reflector, showing the incident and reflected electromagnetic waves being parallel.
Figure 3D:
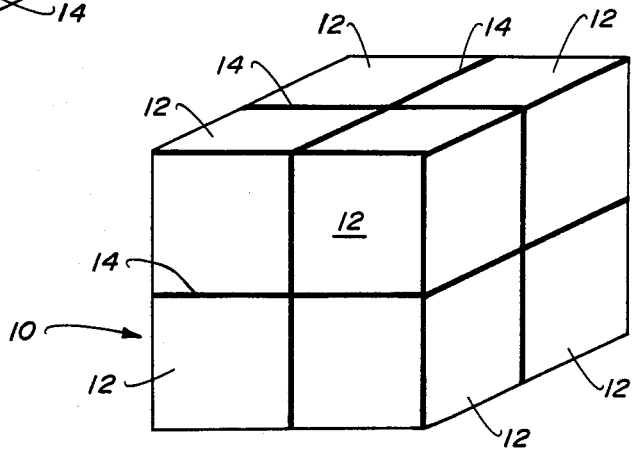

The square corner reflectors formed in the target device, as shown in FIG. 3*d*, have a reflectance that is nine times that of the triangular corner reflectors, such as in FIG. 1*a*, commonly used in radar reflective targets. The reflector, as used in the present device, can be easily constructed to precise specifications. The only precision work necessary is in the making of the eight cubes, as in FIG. 3*b*. The rigidity of the plastic foam ensures that the corner reflector surfaces will remain flat and orthogonal thus preventing degradation of cross-section caused by lack of flatness and orthogonality due to warp or distortion. The target is very lightweight, being composed of plastic foam and foil, and is thus buoyant. The low cost of the plastic foam and foil, and the ease and speed of construction makes the target cost very low. In addition, no special tools or skills are required for fabrication. The opposing reflectors in the assembly of FIG. 3*d* provide virtually spherical response thus rendering the reflector assembly effective over virtually all angles. Half the cube, for example the upper half, with half the volume, can be used for surface targets with constant orientation, giving hemispherical coverage.

The radar reflective target, FIG. 3*d*, is an effective augmentation device which produces a large radar echo in spite of its small physical size. These features make it ideally suited for radar augmentation applications in which small craft are required to simulate radar echoes of larger craft. Its low cost, ease of fabrication and buoyancy constitute ideal features for small craft applications where it can be used to increase radar detectability of small craft at sea in inclement weather, used as a radar reflective personnel flotation device and used in general emergency situations requiring radar augmentation.

Because the reflector is rigid, it cannot be deformed by wind loading and thus suffer degraded performance caused by distortion or warping of the flat reflective surfaces. Unlike metallic plate reflectors, physical deformation of the outer surfaces of the plastic foam cubes will not significantly degrade the performance of the device because the reflective surfaces are internal to the solid cube.

Figure 4:
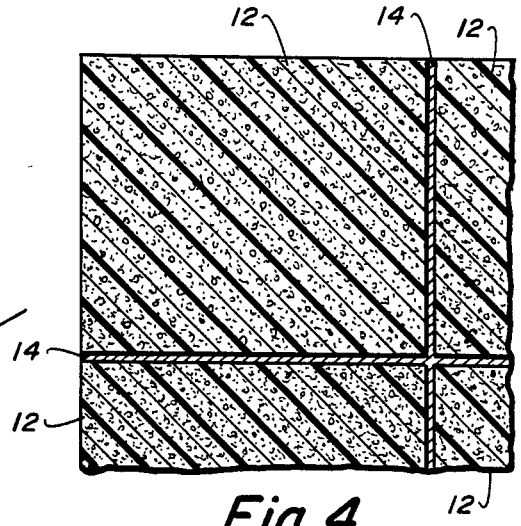
FIG. 4 is a cross sectional view of a portion of a radar reflector device as shown in FIG. 3*d*, and having only a single reflective layer between cubes.

The foam can be any buoyant, radar-transparent material, and the foil or reflective surfaces can be of any suitable material that will reflect radar waves, metallic materials being the most effective. It is not necessary to begin construction with one large block of foam that is cut into eight small blocks. Individual small blocks may be used as long as they are all true cubes of the same size. The radar reflective surface material can be applied in the form of a metallic coating sprayed or painted on the internal surfaces of the cubes, for example, although metallic foil, adhesively attached, appears to be most suitable and convenient. Also, there need be only a single layer of radar reflective material in the planes of the reflective surfaces 14 shown in FIG. 3*d*, such as shown in the cross sectional view of FIG. 4. As shown in FIG. 4, only one of the adjoining internal surfaces are required to have a radar reflective surface since when the cubes are reassembled, as in FIGS. 3*d* and 4, one radar reflective layer 14 will operate to reflect from both surfaces for two opposite corner reflectors, as shown.

Obviously, many modifications and variations of the present invention are possible in the light of the above teachings. It is therefore to be understood that within the scope of the appended claims the invention may be practiced otherwise than as specifically described.

What is claimed is:

1. A lightweight, buoyant and omnidirectional radar augmentation device which prevents degradation of cross-section caused by lack of flatness and orthogonality of the reflecting surfaces, comprising:

a. a solid cubical assembly formed from eight individual equal sized cubes of rigid, lightweight, buoyant, radar-transparent material;

b. at least one thin planar layer of highly radar reflective material between each adjoining internal surface of said eight cubes of radar-transparent material forming said solid cubical assembly; said radar reflective material between the adjoining surfaces forming an internal assembly of eight square corner radar reflectors operable to produce a relatively larger radar echo in comparison to its size; said rigid cubes of radar-transparent material preventing warp and distortion of the flat radar reflective material surfaces while maintaining the internal corner radar reflector surfaces flat and orthogonal;

c. means for retaining said eight individual cubes of radar-transparent material and said thin planar layers of highly radar reflective material together in said solid cubical assembly; each side of said cubical assembly being twice the length of a single one of said eight cubes of radar-transparent material.

2. A radar augmentation device as in claim 1 wherein said cubes of rigid radar-transparent material are made from low density, low dielectric foamed plastic.

3. A radar augmentation device as in claim 1 wherein said cubes of rigid radar-transparent material are waterproof.

4. A radar augmentation device as in claim 1 wherein said at least one thin layer of radar reflective material between each adjoining internal surface of said individual cubes of rigid radar-transparent material forming said solid cubical assembly is comprised of thin metallic foil.

5. A radar augmentation device as in claim 1 wherein said at least one thin layer of radar reflective material between each adjoining internal surface of said individual cubes of rigid radar-transparent material forming said solid cubical assembly is comprised of a thin metallic paint.

6. A radar augmentation device as in claim 1 wherein said at least one thin layer of radar reflective material between each adjoining internal surface of said individual cubes of rigid radar-transparent material forming said solid cubical assembly is a thin metallic coating.

7. A radar augmentation device as in claim 1 wherein said means for retaining said radar-transparent cubes and said radar reflective surfaces together in a larger said solid cubical assembly is a thin layer of adhesive cement material.

8. A radar augmentation device as in claim 1 wherein the outer surface of said solid cubical assembly is coated with a radar transparent waterproof coating.

9. A radar augmentation device as in claim 1 wherein said solid cubical assembly is buoyant and operable to be floated in the sea as a surface target with constant orientation, giving hemispherical coverage.

10. A radar augmentation device as in claim 1 wherein all opposing corner reflectors of said solid cubical assembly together provide virtually spherical response thus rendering the device effective over all angles.

11. A radar augmentation device as in claim 1 wherein said solid cubical assembly is buoyant and operable as a radar reflective personnel flotation device.

12. A radar augmentation device as in claim 1 wherein physical deformation of the outer radar-transparent material surfaces of said solid cubical assembly will not degrade the performance of the reflective surfaces internal to the solid cubical assembly beyond said outer surfaces.

13. The method of making a lightweight, buoyant and omnidirectional radar augmentation device, comprising:

a. preparing eight individual equal-sized solid cubes of rigid, lightweight, buoyant and waterproof radar-transparent material;

b. preparing at least eight planar radar reflective surfaces of highly radar reflective material;

c. assembling said eight cubes of radar transparent material into a larger cubical assembly with at least one of said eight planar highly radar-reflective surfaces between each adjoining internal surface of said larger cubical assembly to form a solid cubical assembly with flat internal corner radar reflective surfaces which do not warp or distort and thus prevents signal degradation caused by lack of flatness and orthogonally of the reflective surfaces.

14. A method as in claim 13 wherein said planar radar reflective surfaces are each equal in size to one side of one of said eight equal sized cubes.

* * * * *